US007955140B1

(12) United States Patent
Lin et al.

(10) Patent No.: US 7,955,140 B1
(45) Date of Patent: Jun. 7, 2011

(54) SPRING CONNECTOR WITH A BOTTOM COVER AND FABRICATING METHOD THEREOF

(75) Inventors: Jui-Pin Lin, Tu-Cheng (TW); Yung-Yi Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/719,857

(22) Filed: Mar. 8, 2010

(51) Int. Cl.
*H01R 13/24* (2006.01)

(52) U.S. Cl. ..... 439/700; 439/482; 439/824

(58) Field of Classification Search ..... 439/700, 439/482, 824, 135
See application file for complete search history.

(56) References Cited

U.S. PATENT DOCUMENTS 5,573,412 A * 11/1996 Anthony ..... 439/133
6,340,320 B1 * 1/2002 Ogawa ..... 439/824
D478,318 S * 8/2003 Burwell et al. ..... D13/146
6,796,850 B2 * 9/2004 Matsui et al. ..... 439/700
6,957,986 B2 * 10/2005 Jing ..... 439/700
7,094,094 B2 * 8/2006 Zahnen et al. ..... 439/521
7,201,613 B2 * 4/2007 Sasaki ..... 439/700
7,507,110 B1 * 3/2009 Yin et al. ..... 439/482
2004/0077225 A1 * 4/2004 Chun-Fu ..... 439/700
2004/0224570 A1 * 11/2004 Yeh ..... 439/824

* cited by examiner

*Primary Examiner* — Hae Moon Hyeon
(74) *Attorney, Agent, or Firm* — Cheng-Ju Chiang

(57) ABSTRACT

A spring connector includes a barrel made by stamping a metal foil to form with a top opening, a first receiving space, a bottom opening and a cover being capable of being positioned to cover the bottom opening and to space from the bottom opening, a plunger inserted in the barrel from the bottom opening and formed with a head portion exposed outside the barrel, a sliding portion received in the first receiving space, and a second receiving space connected to the first receiving space, a spring insert in the first receiving space and the second receiving space from the bottom opening, of which a bottom portion connects to the cover. Because the cover is made by stamping a metal foil, it is easy to coat a uniform coating layer for improving the conducting quality, and the fabricating time and the cost of the spring connector is reduced.

8 Claims, 9 Drawing Sheets

SPRING CONNECTOR WITH A BOTTOM COVER AND FABRICATING METHOD THEREOF

BACKGROUND OF THE INVENTION

1. Field of the Invention

The present invention relates to a spring connector, more specifically, to a method of fabricating a spring connector.

2. The Related Art

According to progress of electrical technology, various consumer products are developed and popular, such as digital cameras, digital video recorders, mobile phones, etc. The consumer products are equipped with a battery to achieve long-term use. The battery will provide energy to the consumer products through a spring connector interconnecting the battery and a printed circuit board of the consumer products.

A conventional spring connector includes an insulating housing, a conductive spring and a metal plunger. The conductive spring and the metal plunger are received in the insulating housing. One end portion of the conductive spring connects a bottom portion of the metal plunger, and the other end portion connects the printed circuit board of the consumer products. A top portion of the metal plunger connects the battery. Hence the energy will be transmitted to the printed circuit board through the metal plunger and the conduct spring.

However, the conducting path of the conductive spring is long and the resistance of the conductive spring is variable because the conductive spring will be compressed by the metal plunger. Hence, the conducting quality of the spring connector will be reduced.

Please refer to FIG. 1 and FIG. 2. Another conventional spring connector 900 includes a metal barrel 902, a metal plunger 904 and a coil spring 906. The metal barrel 902 includes a bottom plate 908 horizontally extended from a bottom portion thereof, a first shoulder 910 bent inward from a top portion thereof, an opening 912 defined at a middle portion of the first shoulder 910, a first receiving space 914 defined therein and a first concavity 916 defined at a top surface of the bottom plate 908 and positioned in the first receiving space 914.

The metal plunger 904 includes a narrow head portion 918, a wide sliding portion 920 extended from a bottom portion of the narrow head portion 918, a second shoulder 922 formed between the narrow head portion 918 and the wide sliding portion 920, a second receiving space 924 defined therein and opened at a bottom surface of the wide sliding portion 920 and a second concavity 926 defined at a top portion of the second receiving space 924.

Please refer to FIG. 3 to FIG. 6. A fabricating method of the conventional spring connector 900 includes following steps:

step 802: lathing the metal barrel 902 and the metal plunger 904, and providing the coil spring 906;

step 804: positioning the coil spring 906 in the first receiving space 914 of the metal barrel 902, and connecting a bottom portion of the coil spring 906 to the first concavity 916 of the bottom plate 908;

step 806: positioning the wide sliding portion 920 of the metal plunger 904 in the first receiving space 914 to connect the first receiving space 914 of the metal barrel 902 to the second receiving space 924, enclosing a top portion of the coil spring 906 in the second receiving space 924 of the metal plunger 904, and connecting a top portion of the coil spring 906 to the second concavity 926; and step 808: bending the top portion of the metal barrel 902 inwardly to form the first shoulder 910 and the opening 912 by an assisting tool, engaging the first shoulder 910 of the metal barrel 902 with the second shoulder 922 of the metal plunger 904 to retain to wide sliding portion 920 of the metal plunger 904 in the first receiving space 914 of the metal barrel 902 and expose the metal plunger 904 outside the opening 912 of the metal barrel 902.

The bottom plate 908 of the metal barrel 902 connects to the printed circuit board of the consumer products. The narrow head potion 918 of the metal plunger 904 connects to the battery and is pressed to slide into the first receiving space 914 of the metal barrel 902 by the battery. Hence, the metal plunger 904 is biased to connect to the metal barrel 902 because the opposite ends of the coil spring 906 abut against the first concavity 916 of the metal barrel 902 and the second concavity 926 of the metal plunger 904.

The energy will be transmitted from the battery to the printed circuit board through the metal plunger 904 and the metal barrel 902. The conducting path is therefore reduced to improve the conducting quality.

However, the conventional spring connector 900 includes the following defects. First, the first concavity 916 of the metal barrel 902 is hardly to be coated a high conductive material. Second, the resistance of the spring connector 900 will be increased if the coating layer on the first concavity 916 is uneven. Third, the temperature of the spring connector 900 will be improved in used if the coating layer on the first concavity 916 is uneven. Fourth, the metal barrel 902 is hard to be fabricated by lathing and the cost thereof will be increased.

SUMMARY OF THE INVENTION

An object of the present invention is to provide a spring connector.

According to the invention, the spring connector includes a barrel, a plunger and a spring. The barrel includes a first shoulder bent inwardly from a top portion thereof, a top opening defined at a middle portion of the first shoulder, a first receiving space defined therein and connected to the top opening, a bottom opening defined at a bottom portion thereof, a cover and a connecting tab interconnecting the cover and the barrel. The connecting tab is bent to position the cover to cover the bottom opening.

The plunger includes a head portion exposed outside the barrel, a sliding portion extended from a bottom portion of the head portion and received in the first receiving space of the barrel, a second shoulder formed between the head portion and the sliding portion and received in the first receiving space and abutted against the first shoulder of the barrel, and a second receiving space defined therein and connected to the first receiving space.

The spring is received in the first receiving space and the second receiving space. A top end portion of the spring is received in the second receiving space and connected to the plunger. A bottom end portion of the spring is received in the first receiving space and connected to the cover.

Another object of the present invention is to provide a fabricating method of the spring connector.

According to the invention, the fabricating method includes steps of stamping a metal foil to form the barrel with the cover, the connecting tab interconnecting the barrel and the cover, the bottom opening defined at the bottom portion thereof, the first receiving space defined therein and connected to the bottom opening, the first shoulder bent inward from the top portion thereof and the top opening defined in the middle portion of the first shoulder and connected to the first receiving space; providing the plunger formed with the head portion, the sliding portion extended from the bottom portion of the head portion, the second shoulder formed between the head portion and the sliding portion, the second receiving space defined therein; inserting the plunger into the barrel from the bottom opening until the second shoulder of the plunger abutted against the first shoulder of the barrel to position the sliding portion in the first receiving space and to position the head portion to be passed through the top opening and exposed outside the metal barrel; inserting the spring into the barrel from the bottom opening to position the top end portion of the coil spring in the second receiving space and to connect to the plunger; and bending the connecting tab to position the cover to cover the bottom opening, and to arrange the cover to connect the bottom end portion of the spring.

Because the cover of the metal barrel is made by stamping a metal foil, the cover is easy to be coated with a high conductive material such as a gold. Hence, the coating layer on the cover can be uniform so as to improve the conducting quality. The fabricating time of the spring connector will be reduced because each of the metal barrel and the metal plunger is made by stamping a metal foil. The cost of the spring connector is therefore reduced.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
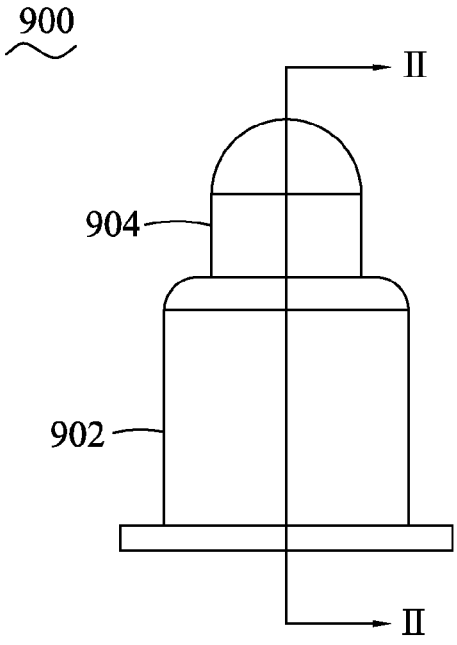
FIG. 1 (Prior Art)
FIG. 1 is a perspective view of a conventional spring connector.
Figure 2:
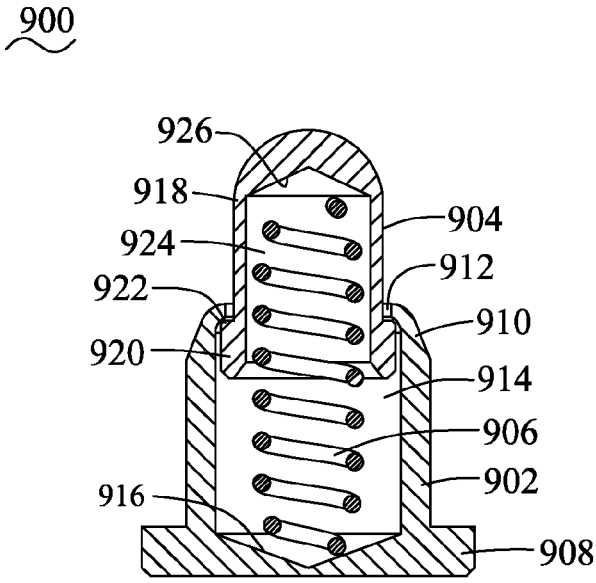
FIG. 2 (Prior Art)
FIG. 2 is a cross section view of the conventional spring connector along II-II in FIG. 1.
Figure 3:
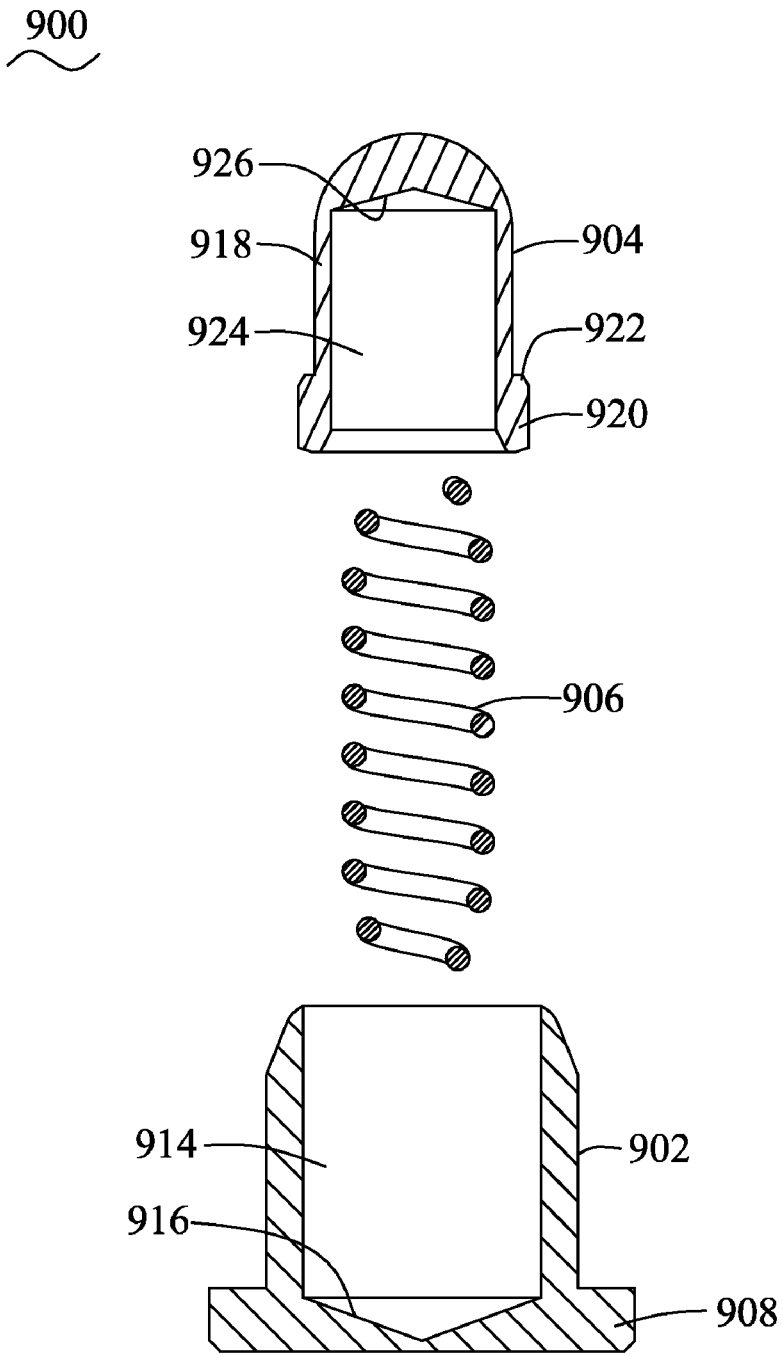
FIG. 3 (Prior Art)
FIG. 3 to FIG. 6 show a fabricating procedure of the conventional spring connector.
Figure 4:
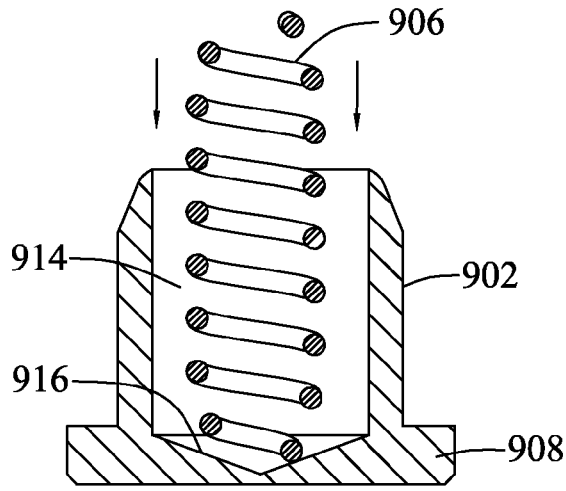
FIG. 4 (Prior Art)
Figure 5:
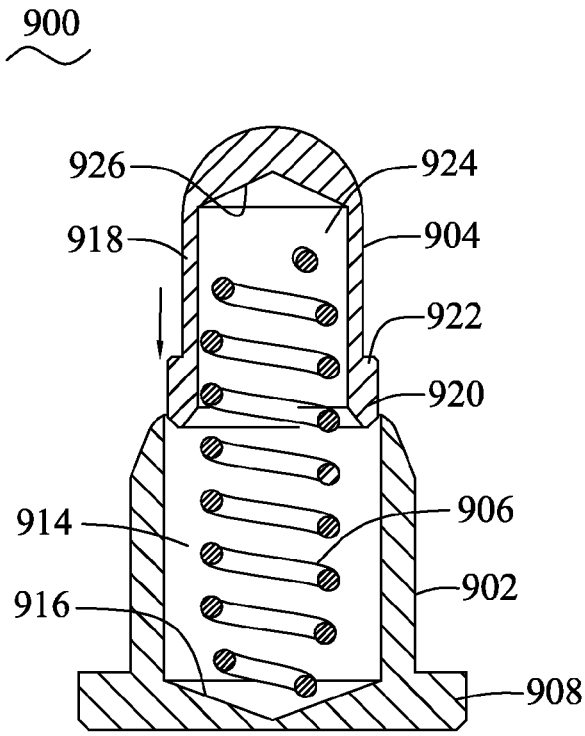
FIG. 5 (Prior Art)
Figure 6:
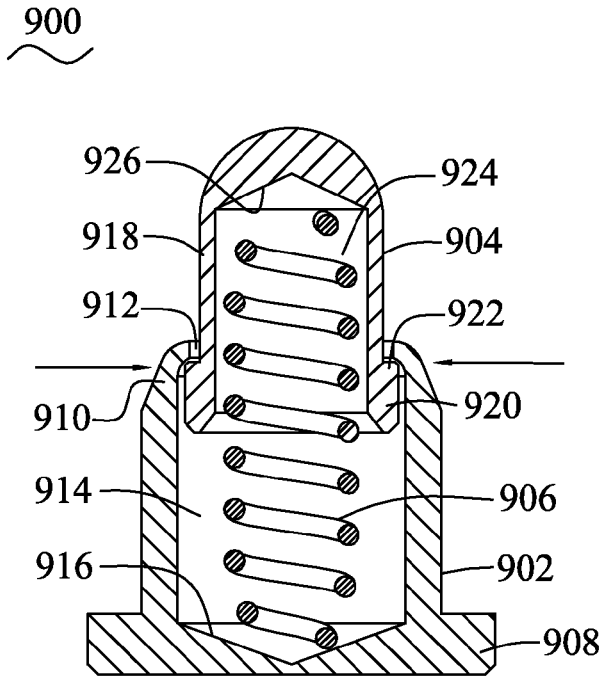
FIG. 6 (Prior Art)
Figure 7:
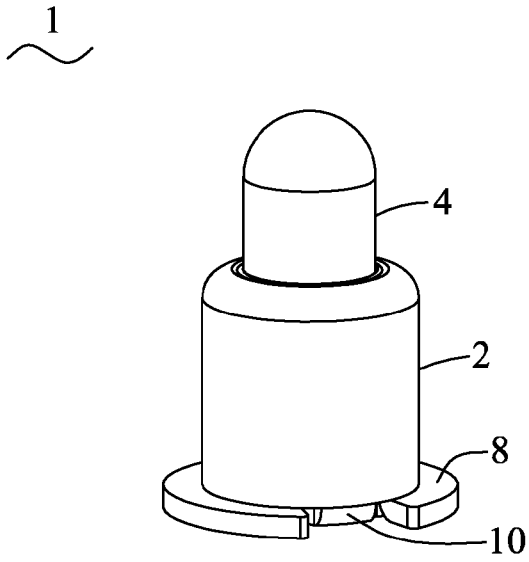
FIG. 7 is a perspective view of a spring connector seen from one side according to the present invention.
Figure 8:
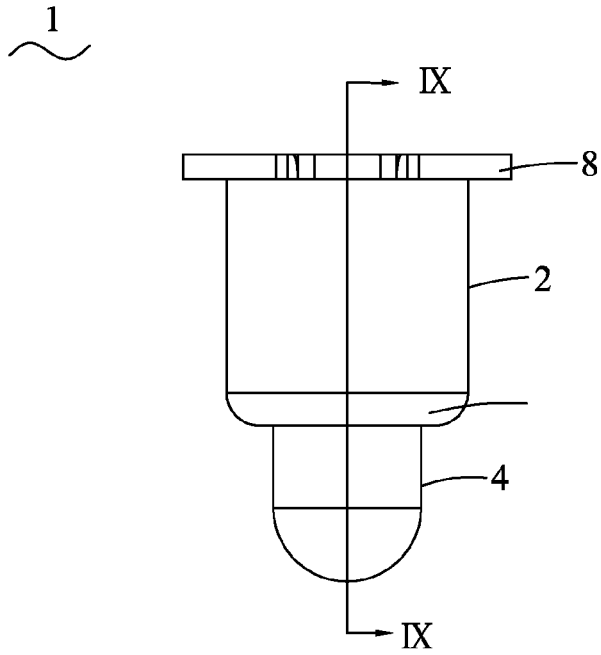
FIG. 8 is a perspective view of a spring connector seen from another side.
Figure 9:
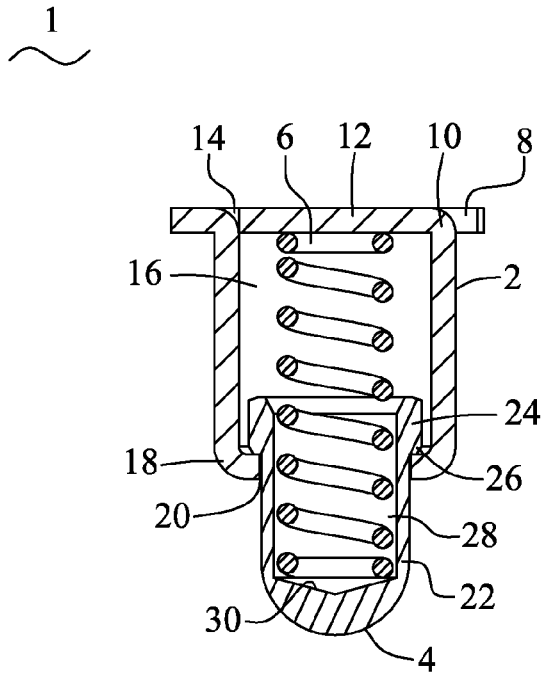
FIG. 9 is a cross section view of the spring connector along IX-IX in FIG. 8.
Figure 10:
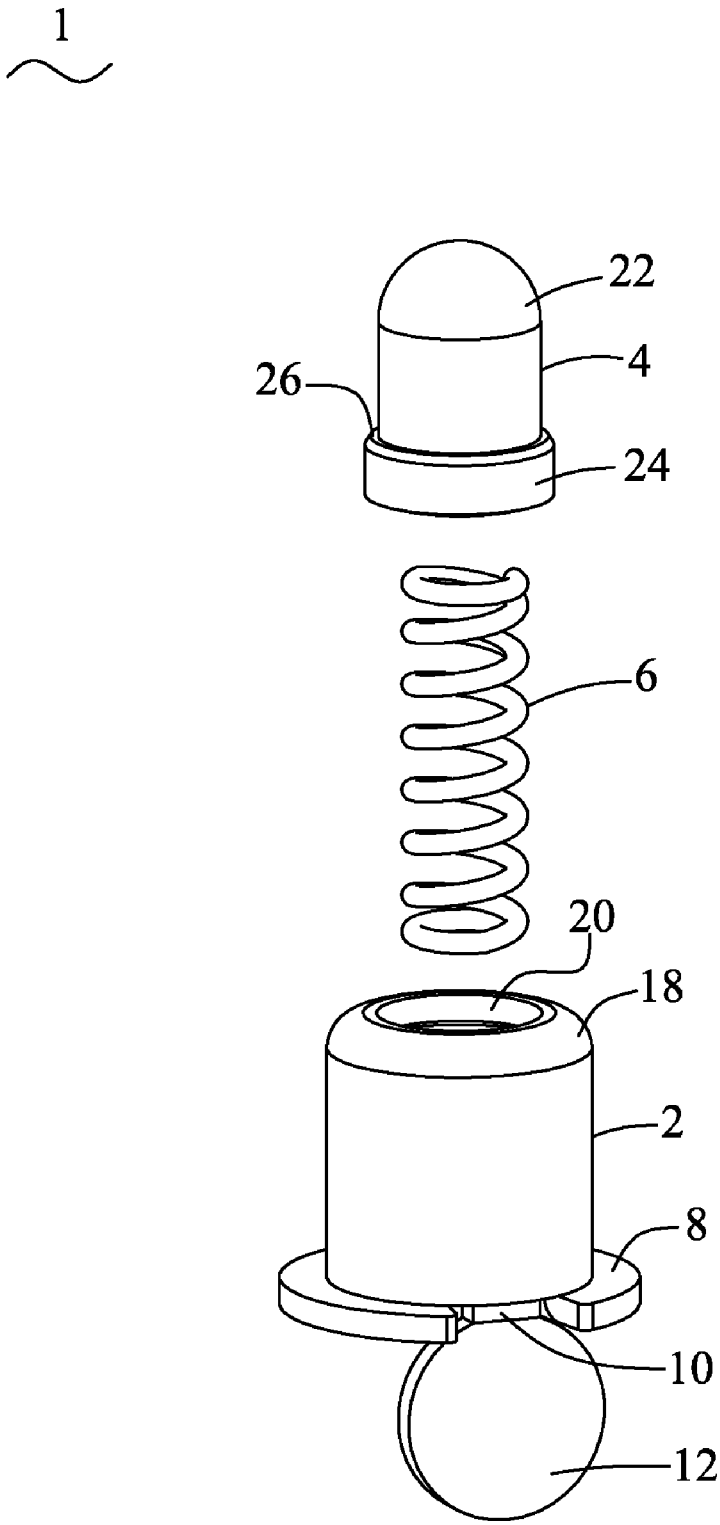
FIG. 10 is an exploded view of the spring connector in FIG. 7.

Please refer to FIG. 7 to FIG. 10. A spring connector 1 according to the present invention includes a metal barrel 2, a metal plunger 4 and a coil spring 6. The barrel 2 includes a bottom plate 8 extending laterally from a bottom edge thereof, a connecting tab 10 extending downward from the bottom edge thereof, a cover 12 extending downward from the connecting tab 10, a bottom opening 14 defined between the bottom edge thereof, a first receiving space 16 defined therein, a first shoulder 18 extending inward from a top portion thereof, a top opening 20 defined at a middle portion of the first shoulder 18. Especially, the metal barrel 2 is made by stamping a metal foil.

The metal plunger 4 includes a narrow head portion 22, a wide sliding portion 24 extending from a bottom portion of the narrow head portion 22, a second shoulder 26 formed between the narrow head portion 22 and the side sliding portion 24, a second receiving space 28 defined therein and opening at a bottom surface of the sliding portion 24 and a concavity 30 defined at a top portion of the second receiving space 28.

The first receiving space 16 connects to the bottom opening 14 and the top opening 20. The diameter of the bottom opening 14 is substantially equal to the diameter of the first receiving space 16, and is larger than the diameter of the top opening 20. The diameter of the wide sliding portion 24 is larger than the diameter of the narrow head portion 22. The diameter of the wide sliding portion 24 is larger than the diameter of the top opening 20, and is smaller than the diameter of the first receiving space 16.

Figure 11:
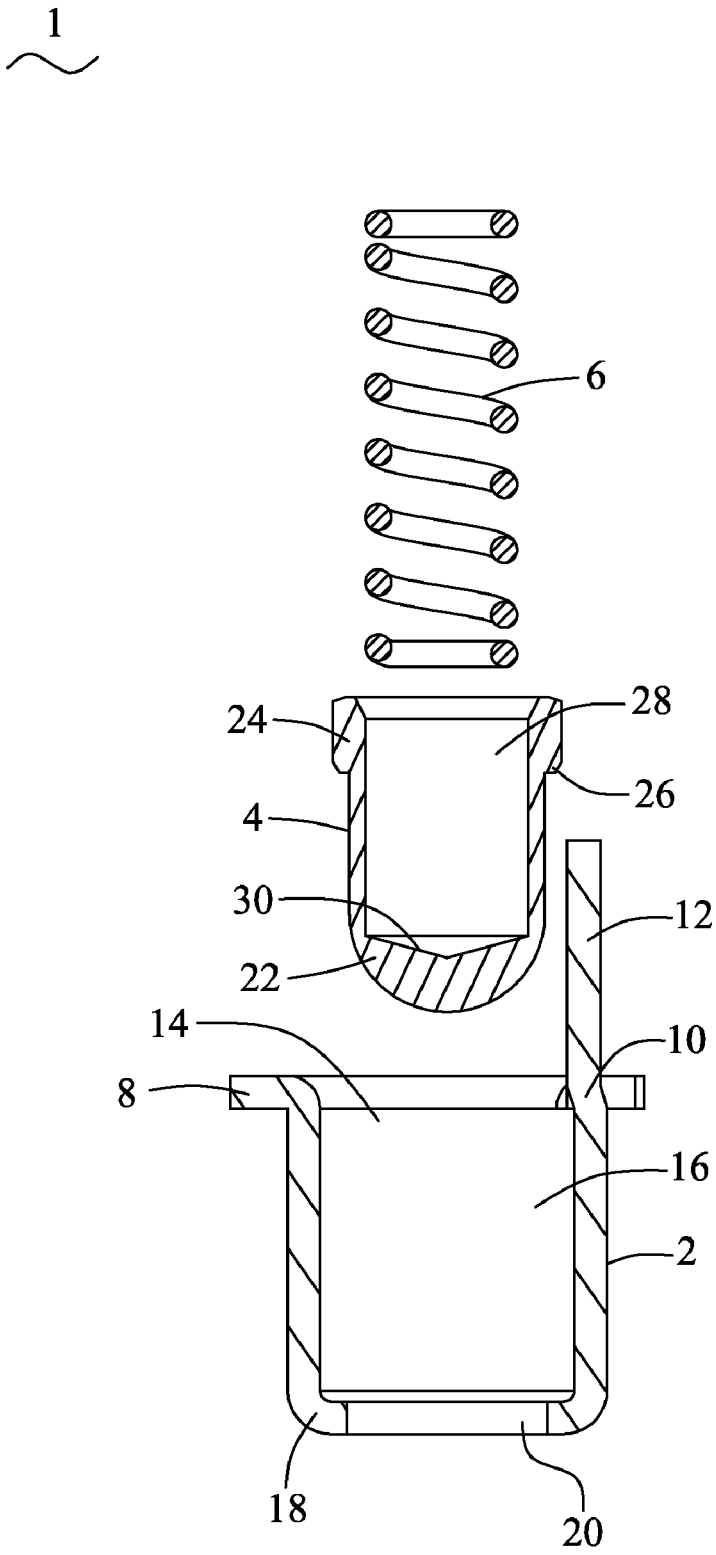
FIG. 11 to FIG. 14 show a fabricating procedure of the spring connector according to the present invention.
Figure 12:
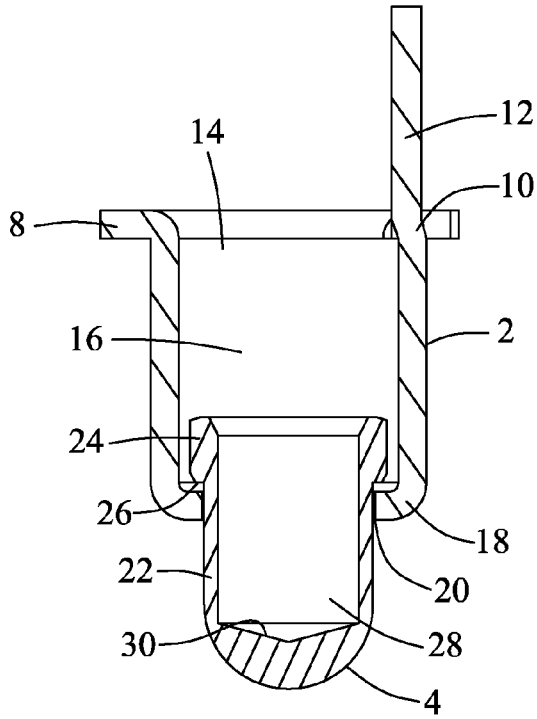
Figure 13:
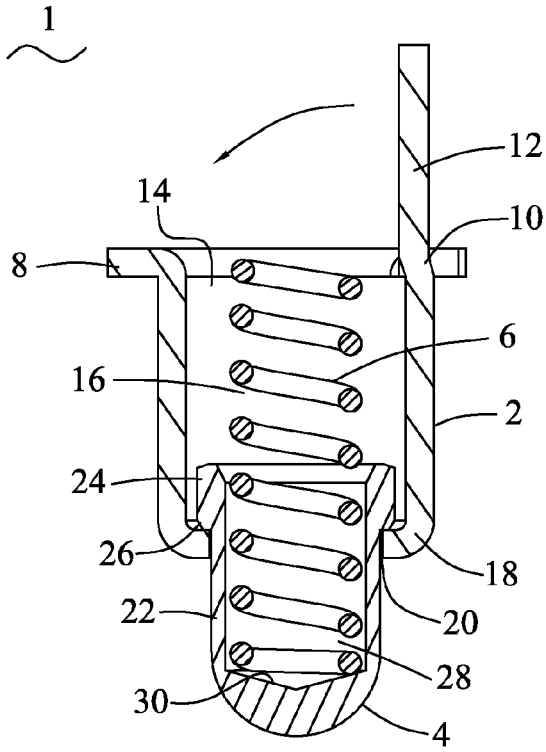
Figure 14:
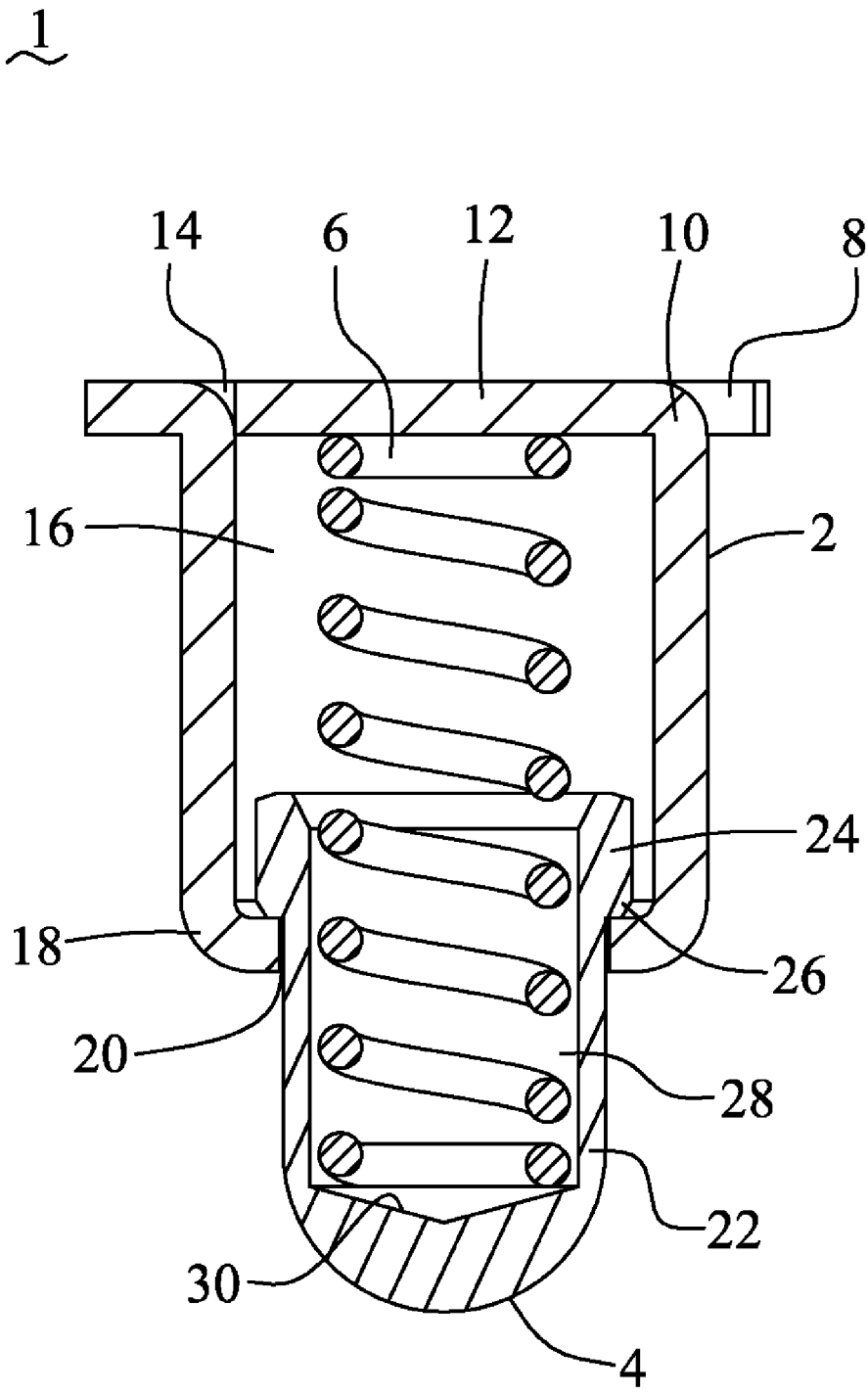

Please refer to FIG. 11 to FIG. 14. A fabricating method of the spring connector 1 includes the following steps.

Step 202: stamping a metal foil to form the metal barrel 2 with the bottom plate 8 bent outward to be vertical to the lateral plate of the metal barrel 2, the connecting tab 10 extended from the bottom edge thereof, the cover 12 extended from the connecting tab 10, the bottom opening defined between the bottom edge thereof, the first receiving space 16 defined therein, the first shoulder 18 bent inward from the top portion thereof and the top opening 20 defined at the middle portion of the first shoulder 18;

Step 204: stamping a metal foil to form the metal plunger 4 with the narrow head portion 22, the wide sliding portion 24 extended from the bottom portion of the narrow head portion 22, the second shoulder 26 formed between the narrow head portion 22 and the wide sliding portion 24, the second receiving space 28 defined therein, and the concavity 30 defined at the top portion of the second receiving space 28;

Step 206: inserting the metal plunger 4 into the metal barrel 2 from the bottom opening 14 until the second shoulder 26 of the metal plunger 4 abutted against the first shoulder 18 of the metal barrel 2 to position the wide sliding portion 24 of the metal plunger 4 in the first receiving space 16 and the narrow head portion 22 to be passed through the top opening 20 and exposed outside the metal barrel 2;

Step 208: inserting the coil spring 6 into the metal barrel 2 from the bottom opening 14 to position a top end portion of the coil spring 6 in the second receiving space 28 and to connect to the concavity 30 of the metal plunger 4; and Step 210: bending the connecting tab 10 by an assisting tool to position the cover 12 to cover the bottom opening 14, and to arrange the cover 12 to connect a bottom end portion of the coil spring 6 and enclose the coil spring 6.

Hence, the coil spring 6 is retained in the first receiving space 16 of the metal barrel 2 and the second receiving space 28 of the metal plunger 4. The top end portion of the coil spring 6 connects to the concavity 30 of the metal plunger 4, and the bottom end portion connects to the cover 12 of the barrel 2. Especially, the bottom plate 8 and the cover 12 are at the same level.

The bottom plate 8 of the metal barrel 2 connects to a printed circuit board of an electrical product (not shown in figures), and the narrow head portion 22 of the metal plunger 4 connects to a contact of a battery (not shown in figures). The metal plunger 4 is pressed by the battery to slide into the first receiving space 16 of the metal barrel 2 and to compress the coil spring 6.

Because the top end portion of the coil spring 6 connects the concavity 30 of the metal plunger 4, the metal plunger 4 is biased to connect to the metal barrel 2. Hence, the energy of the battery will be transmitted to the printed circuit board through the metal plunger 4 and the metal barrel 2. The conducting path is therefore reduced to improve the conducting quality.

As described above, the cover 12 of the metal barrel 2 is easy to be coated a high conductive material such as a gold because it is made by stamping a metal foil. The coating layer on the cover 12 can be uniform to improve the conducting quality. The fabricating time of the spring connector 1 will be reduced because of each of the metal barrel 2 and the metal plunger 4 is made by stamping a metal foil. The cost of the spring connector 1 is therefore reduced.

Furthermore, the present invention is not limited to the embodiments described above; diverse additions, alterations and the like may be made within the scope of the present invention by a person skilled in the art. For example, respective embodiments may be appropriately combined.

What is claimed is:

1. A spring connector comprising:

a barrel comprising a first shoulder bent inwardly from a top portion thereof, a top opening defined at a middle portion of the first shoulder, a first receiving space defined therein and connected to the top opening, a bottom opening defined at a bottom portion thereof, a cover and a connecting tab interconnecting the cover and the barrel, the connecting tab being bent and extending from the bottom portion of the barrel to position the cover to cover the bottom opening, and the cover being flush with the bottom portion of the barrel;

a plunger comprising a head portion exposed outside the barrel, a sliding portion extended from a bottom portion of the head portion and being wider than the head portion and received in the first receiving space of the barrel, a second shoulder formed between the head portion and the sliding portion and received in the first receiving space and abutted against the first shoulder of the barrel, and a second receiving space defined therein and connected to the first receiving space; and a spring received in the first receiving space and the second receiving space, a top end portion of the spring received in the second receiving space and connected to the plunger, a bottom end portion of the spring received in the first receiving space and connected to the cover.

2. The spring connector as claimed in claim 1, wherein a top portion of the second receiving space defines a concavity connected to the top end portion of the spring.

3. The spring connector as claimed in claim 1, wherein a bottom plate extends laterally from a bottom edge of the bottom portion of the barrel, and the bottom plate and the cover are at the same level.

4. The spring connector as claimed in claim 1, wherein the connecting tab is located aside relative to the bottom portion of the barrel and provides the only support for the cover to be positioned and cover the bottom opening.

5. A method of fabricating a spring connector comprising:

stamping a metal foil to form a barrel with a cover, a connecting tab interconnecting the barrel and the cover, a bottom opening defined at a bottom portion thereof, a first receiving space defined therein and connected to the bottom opening, a first shoulder bent inward from a top portion thereof and a top opening defined in a middle portion of the first shoulder and connected to the first receiving space, wherein the connecting tab extends from the bottom portion of the barrel;

providing a plunger formed with a head portion, a sliding portion extended from a bottom portion of the head portion and being wider than the head portion, a second shoulder formed between the head portion and the sliding portion, a second receiving space defined therein;

inserting the plunger into the barrel from the bottom opening until the second shoulder of the plunger abutted against the first shoulder of the barrel to position the sliding portion in the first receiving space and the head portion to be passed through the top opening and exposed outside the metal barrel;

inserting a spring into the barrel from the bottom opening to position a top end portion of the spring in the second receiving space and to connect to the plunger; and bending the connecting tab to position the cover to cover the bottom opening, and to arrange the cover to connect a bottom end portion of the spring; wherein the cover is flush with the bottom portion of the barrel.

6. The method as claimed in claim 5, wherein the plunger is made by stamping a metal foil.

7. The method as claimed in claim 5, wherein a bottom plate extends laterally from a bottom edge of the bottom portion of the barrel, and the bottom plate and the cover are at the same level.

8. The method as claimed in claim 5, wherein the connecting tab is located aside relative to the bottom portion of the barrel and provides the only support for the cover to be positioned and cover the bottom opening.

* * * * *